US006282760B1

(12) United States Patent
Mars

(10) Patent No.: US 6,282,760 B1
(45) Date of Patent: Sep. 4, 2001

(54) MAGNETIC ATTACHMENT DEVICE

(76) Inventor: Mary Kay Mars, 3221 Royal La., Dallas, TX (US) 75229

( * ) Notice: Subject to any disclaimer, the term of this patent is extended or adjusted under 35 U.S.C. 154(b) by 0 days.

(21) Appl. No.: 09/402,147

(22) PCT Filed: Mar. 25, 1998

(86) PCT No.: PCT/US98/05561

§ 371 Date: Sep. 27, 1999

§ 102(e) Date: Sep. 27, 1999

(87) PCT Pub. No.: WO98/42225

PCT Pub. Date: Oct. 1, 1998

Related U.S. Application Data

(63) Continuation-in-part of application No. 08/824,562, filed on Mar. 26, 1997, now Pat. No. 5,732,451.

(51) Int. Cl.[7] ..... A44B 21/00
(52) U.S. Cl. ..... 24/303
(58) Field of Search ..... 40/1.5, 1.6, 661.01, 40/600; 63/900, 29.2; 24/303, 66.1

(56) References Cited

U.S. PATENT DOCUMENTS 2,592,395 * 4/1952 Cummings .
2,975,497 * 3/1961 Budreck .
3,141,216 * 7/1964 Brett .
3,850,010 * 11/1974 Noto .
4,031,652 * 6/1977 Johnson .
4,231,137 * 11/1980 Fujimoto .
4,236,331 * 12/1980 Mattson .
4,982,581 * 1/1991 Furuyama .
5,050,276 * 9/1991 Pemberton .
5,347,733 * 9/1994 Whittington .
5,369,899 * 12/1994 Reeves .
5,432,986 * 7/1995 Sexton .
5,508,070 * 4/1996 DiLapo et al. .
5,682,648 * 11/1997 Miller .
5,732,451 * 3/1998 Mars .
5,771,618 * 6/1998 Burke et al. .

FOREIGN PATENT DOCUMENTS 5-42012 * 2/1993 (JP) .

* cited by examiner

*Primary Examiner*—James R. Brittain
(74) *Attorney, Agent, or Firm*—Thompson & Knight L.L.P.

(57) ABSTRACT

A device for magnetically attaching jewelry, name tags or the like to garments and apparel items. The device includes inner (36) and outer (42) magnets and an anchor (48) attached to the outer magnet (42). A pin-secured jewelry article or name tag is secured to the garment by passing the pin (26) through a passageway in the anchor (48) and then bringing the inner (36) and outer (42) magnets into magnetically close proximity on opposite sides of the garment. In another embodiment, a display device includes a socket on its back surface for retaining a first magnet, and a second magnet secures the display device to an apparel item interposed between the magnets.

10 Claims, 3 Drawing Sheets

FIG. 1
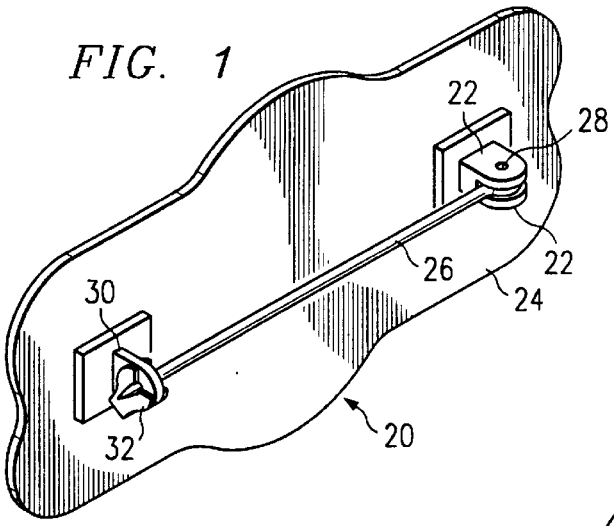
FIG. 2
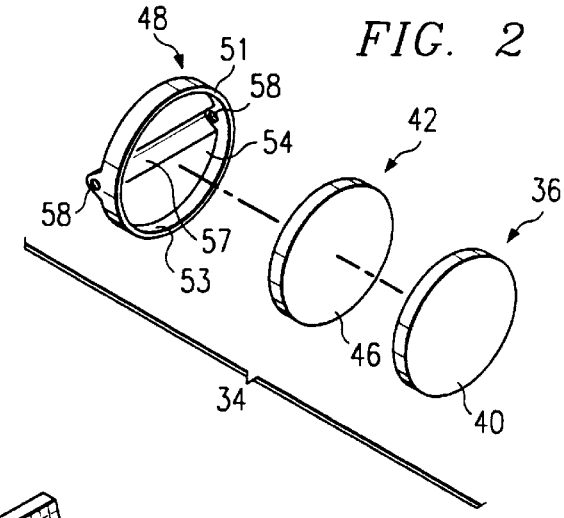
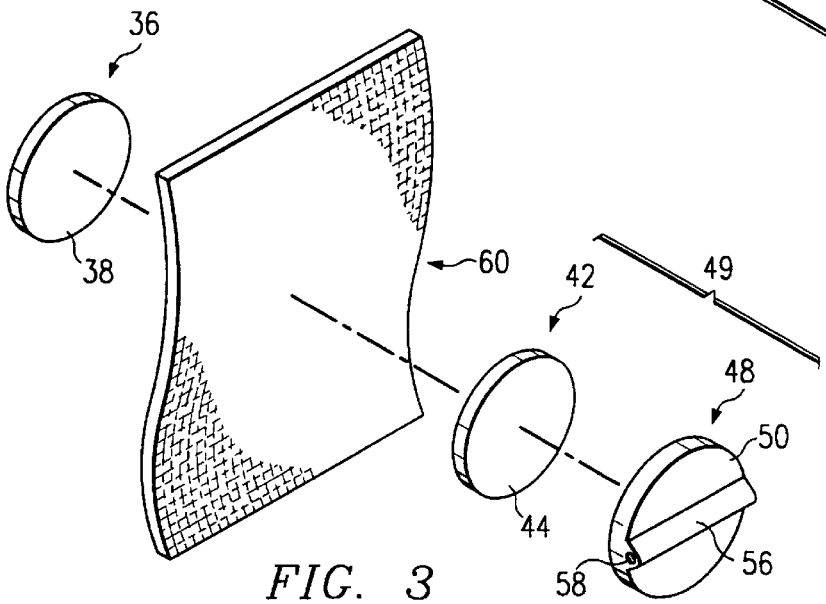
FIG. 3

MAGNETIC ATTACHMENT DEVICE

This application is a continuation in part of application Ser. No. 08/824,562 filed Mar. 26, 1997, now U.S. Pat. No. 5,732,451, issued Mar. 31, 1998.

BACKGROUND OF THE INVENTION

The present invention relates to the attachment of jewelry, name tags and similar articles to garments, and more particularly to device for magnetically attaching brooches, buttons, insignia, jewelry, name tags, ribbons, stick pins, and other decorative or informative articles to garments.

The attachment of decorative articles, such as brooches, buttons, jewelry or stick pins to garments is a common practice. At business and social functions, people are often asked to attach information articles, such as name tags or buttons to their garments. Such decorative or informative articles typically have a hinged pin and clasp on the back. The decorative or informative article is attached to a garment by inserting the pin through the front of the garment, passing the pin underneath the garment for a short distance and then bringing the pin back out to the front side of the garment, whereupon the pin is secured in the closed position. The holes created by the pin can cause unacceptable damage to the garment, especially when the garment is made from fine silk or other delicate fabric. Even more durable fabrics are not immune to such damage, especially after repeated use of these decorative or informative articles.

Reluctant to damage their fine clothing, many people avoid wearing brooches and similar pin-secured jewelry articles, and refuse to wear pin-secured name tags or other informative articles. There is, accordingly, a need for a method of attaching these decorative or informative articles to garments without damaging the garments.

SUMMARY OF THE INVENTION

In accordance with the present invention, a device is provided for magnetically attaching brooches, buttons, insignia, jewelry, name tags, ribbons, stick pins, and other decorative or informative articles to garments without damaging the garment with pin holes.

In one embodiment, the decorative or informative articles has a pin attachment mechanism on its back surface. The device of the present invention includes an inner magnet, an outer magnet and an anchor attached to the outer magnet. The anchor includes a passageway for insertion of a pin of a pin-backed decorative or informative article. When the article is attached to the anchor by passing the pin through the passageway, the article can be attached to the garment by bringing the inner and outer magnets into magnetically close proximity on the opposite sides of the garment.

In another embodiment of the invention, a display device for attachment to an item of apparel includes a casing with a socket at the back thereof, a first magnet retained in the socket, and a second magnet that can be brought into close proximity with the first magnet on the opposite side of a thin portion of the apparel, whereby an article of jewelry or an informative article can be worn by the user without damaging the item of apparel.

The presently preferred ways of carrying out the invention are described in detail below with reference to the accompanying drawings.

BRIEF DESCRIPTION OF THE DRAWINGS

FIG. 1 is a perspective view of a typical pin and clasp arrangement attached to the rear face of a decorative of informative article;

FIG. 2 is an exploded perspective view of a device in accordance with a preferred embodiment of the invention;

FIG. 3 is an exploded perspective view of the device of FIG. 2 and a portion of a garment, which is shown broken away, the point of view differing from that of FIG. 2 to show the opposite faces of the device;

DESCRIPTION OF THE PREFERRED EMBODIMENTS

Figure 4:
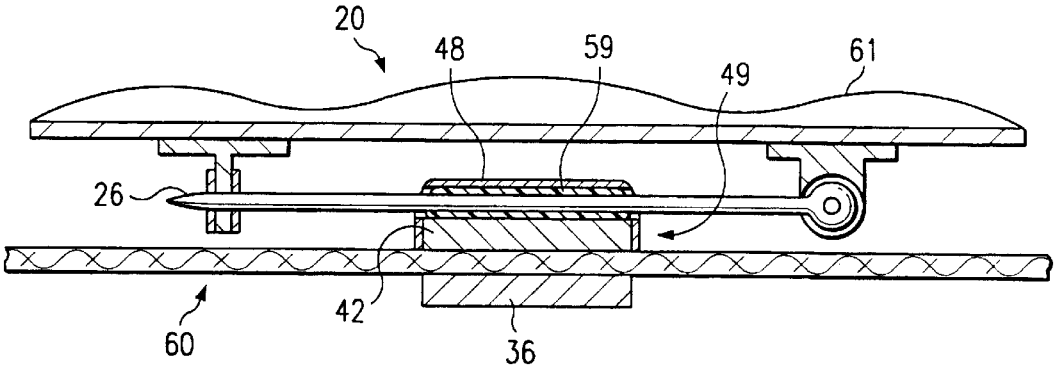
FIG. 4 is a cross-sectional view of the device of FIG. 2 attached to a typical pin of a decorative or informative article and a garment, shown partially, the article having a pin inserted through an anchor attached to an outer magnet disposed adjacent to an inner magnet on the opposite side of the garment.

Referring to FIG. 1, a decorative or informative article, such as a brooch, button, insignia, jewelry, name tag, ribbon, or stick pin, is indicated generally by reference numeral 20. The particular article 20 may be any conventional article with which the innovative device can be used. FIG. 1 illustrates the back of the article 20 to which a typical pin and clasp mechanism are secured. A pair of parallel spaced plates 22 are attached to and extend from the rear surface 24 of the article 20. A pin 26 is pivotally or hingedly secured between the plates 22 by a shaft 28. Also attached to and extending from the rear surface 24 is a clasp 30 positioned adjacent to the free end of the pin 26 when the pin 26 is in the closed position. The clasp 30 includes a latch 32 for locking the pin 26 in the closed position. The element described above illustrate a typical mechanism for attaching the article 20 to a garment (not shown) using the 26 and clasp 30.

Referring to FIGS. 2 and 3, a magnetic attachment device according to the invention is indicated generally by reference numeral 34 and comprises an inner magnet 36, an outer magnet 42 and an anchor 48. The inner magnet 36 has a first surface 38 defining a first magnetic pole (e.g., north) and a second surface 40 defining a second magnetic pole (e.g., south) opposite in polarity to the first magnetic pole. The outer magnet 42 has a first surface 44 defining a first magnetic pole (e.g., north) and a second surface 46 defining a second magnetic pole (e.g., south) opposite in polarity to the first magnetic pole. In this embodiment, the magnets 36 and 42 are identical disk-shaped magnets. As seen in FIG. 3, they are placed on opposite sides of a garment 60 to secure an informative or decorative article to the garment in a manner described more fully below.

The anchor 48 is preferably a socket defined by a back plate 50 and a cylindrical rim 51. The inner wall 53 of the rim 51 and inner wall 54 of the back plate 50 define a receptacle or cavity shaped to conform to the shape of the outer magnet 42 and snugly hold the magnet 42 therein. The diameter of the outer magnet 42 is just slightly smaller than the diameter of the inner wall 53 so that the outer magnet can be inserted in the cavity of the socket 48. The outer magnet 42 can be secured in the socket 48 by crimping the rim 51 to tightly engage the edge of the outer magnet. It will be understood that in use the outer magnet 42 and socket 48 define a single assembled unit 49 of the magnetic attachment device 34.

The socket 48 has a raised portion 56 on the back plate 50 defining an elongated passageway 57 connecting openings 58 on opposite sides of the socket 48. The passageway 57 and openings 58 are sized to permit the insertion of a typical pin 26 of the type shown in FIG. 1. The socket 48 is preferably metal such as copper or brass and is shaped by stamping from a sheet. Thus, the cylindrical rim 51 and raised portion 56 can formed in a single stamping operation. To provide an attractive appearance and corrosion-resistant surface, the socket 48 is preferably nickel, silver, gold, or platinum plated after stamping.

The rim 51 is shaped to receive the outer magnet 42 such that when the first surface 44 of the outer magnet 42 is flush against the inner wall 54 of the back plate 50, the second surface 46 of the outer magnet is substantially flush with the free edge of the rim 51. The outer magnet 42 may be frictionally secured within the cavity defined by the walls 53 and 54, and may be further secured with an adhesive applied within the cavity. Preferably, however, before the outer magnet 42 is inserted into socket 48, a small amount of a soft polymer coating is placed within the passageway 57. After the outer magnet 42 is inserted into the socket 48, the rim 51 is crimped against the edges of the magnet 42.

Referring to FIG. 4, the article 20 is shown secured to a garment 60. A decorative outer face 61 of the article 20 is exposed in essentially the same manner as if the article had been secured by passing the pin 26 through the garment 60. The article 20 can be attached to the anchor or socket 48 by passing the pin 26 through the passageway 57 and openings 58 and securing the pin 26 in the closed position. The assembled article 20 and socket 48 can be secured to the garment 60 by bringing the inner magnet 36 and the outer magnet 42 into magnetically close proximity, with their magnetic poles oriented to attract each other, on the opposite sides of a portion of the garment 60.

Figure 5:
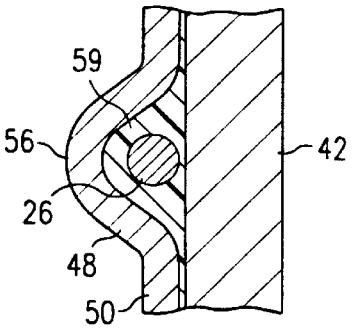
FIG. 5 is a partial cross section taken perpendicular to the longitudinal axis of the pin and through the center of the outer magnet and anchor of FIG. 4.

Referring to FIG. 5, a center section of the socket 48 is shown with the outer magnet 42 installed therein. The passageway beneath the raised portion 56 is filled with a soft polymer coating 59, which extends beyond the passageway to form a thin film between the flat adjacent surfaces of the back plate 50 and the magnet 42. The polymer coating 59 is soft enough to permit a typical pin 26 to be pushed through the passageway of the socket 48 in the manner depicted in FIG. 4. The polymer coating 59 frictionally engages the pin 26 once inserted through the passageway so that the article 20 will not slide, rotate or wobble relative to the socket 48. Various polymer coatings 59 can perform this function, clear 100% silicone sealant manufactured by Dow Corning being a suitable example. It has been found that such silicone material will permit many insertions and withdrawals of a typical pin 26 without losing the ability to prevent sliding, rotation or wobbling of the article 20 relative to the socket 48.

Referring again to FIG. 3, since the inner magnet 36 is placed inside a garment 60, the inner magnet 36 is preferably disk-shaped or has rounded edges so that it does not scratch or irritate the person wearing the magnetic attachment device 34. The inner magnet 36 is also preferably small enough to be comfortably worn in close proximity to a person's skin, yet large enough to facilitate easy handling and positioning of the inner magnet 36 inside the garment 60. The combined magnetic strength of the inner magnet 36 and outer magnet 42 is preferably sufficient to keep a large, bulky, or heavy article 20, shown in FIG. 1, in place and withstand incidental movement of such article 20. The shape, size and magnetic strength of the magnets 36 and 42 are selected based on the shape, size and weight of the article 20 and the thickness of a typical garment. Various suitable magnets with strong magnetic properties are commercially available. A preferred magnet is the Neodymium-Iron-Boron disc-shaped magnet, grade 35 (35 million energy product) having a diameter of 0.5" and a thickness of 0.125", available from Master Magnetics, Inc., Castle Rock, Colo. 80104, or from Tridus International, 8527 Alondra Blvd., Suite 205, Paramount, Calif. 90723.

Many decorative articles are irregularly shaped or contain open areas that allow the garment to be seen through the decorative article. Therefore, the outer magnet 42 and socket 48 are preferably small enough to remain substantially concealed behind the decorative article 20. Preferably, however, the outer magnet 42 and inner magnet 36 are identical to maximize magnetic efficiency while minimizing size.

Now referring to FIGS. 6 and 7, a device in accordance with an alternate embodiment of the invention will be described. A rectangular-shaped inner magnet 62 has first 64 and second 66 surfaces of opposite magnetic polarity. A rectangular-shaped outer magnet 70 has first 72 and second 74 surface of opposite magnetic polarity, like those of the inner magnet 62. The outer magnet 70 has a tube 76 secured to its first surface 72 in a suitable manner, such as by a strong epoxy adhesive 78. An open-ended passageway 80 extends through the tube 76. Thus, the tube 76 serves as an anchor for the outer magnet 70. A decorative or informative article (such as shown in FIG. 1), can be secured to a garment 60 by passing the pin 26 through the passageway 80 and then bringing the magnets 62 and 70 into close proximity on opposite sides of the garment 60.

Figure 6:
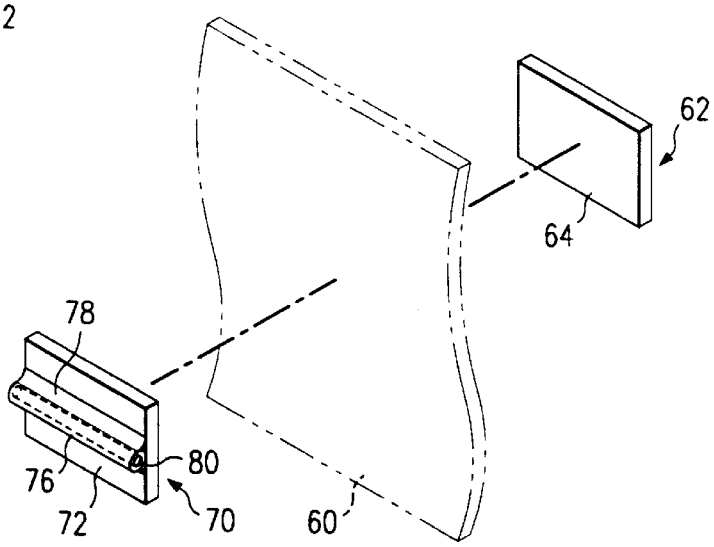
FIG. 6 is an exploded perspective view of a device in accordance with an alternative embodiment of the invention and a portion of a garment, which is shown broken away.
Figure 7:
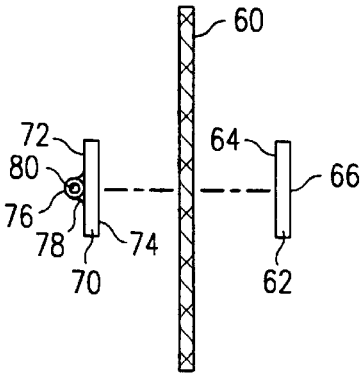
FIG. 7 is a side view of the device of FIG. 6 with a portion of a garment interposed between elements of the device.

It will be appreciated that the embodiment of FIGS. 6 and 7 may be altered to use disk-shaped magnets like those of FIGS. 2 and 3, with the tube 76 replacing the socket 48 as the anchor element. Also, in another variation, rectangular or other non-circular shaped magnets can be used in place of the disk-shaped magnets of FIGS. 2 and 3 with the socket 48 shaped to conform to such rectangular or other non-circular shape.

Figure 8:
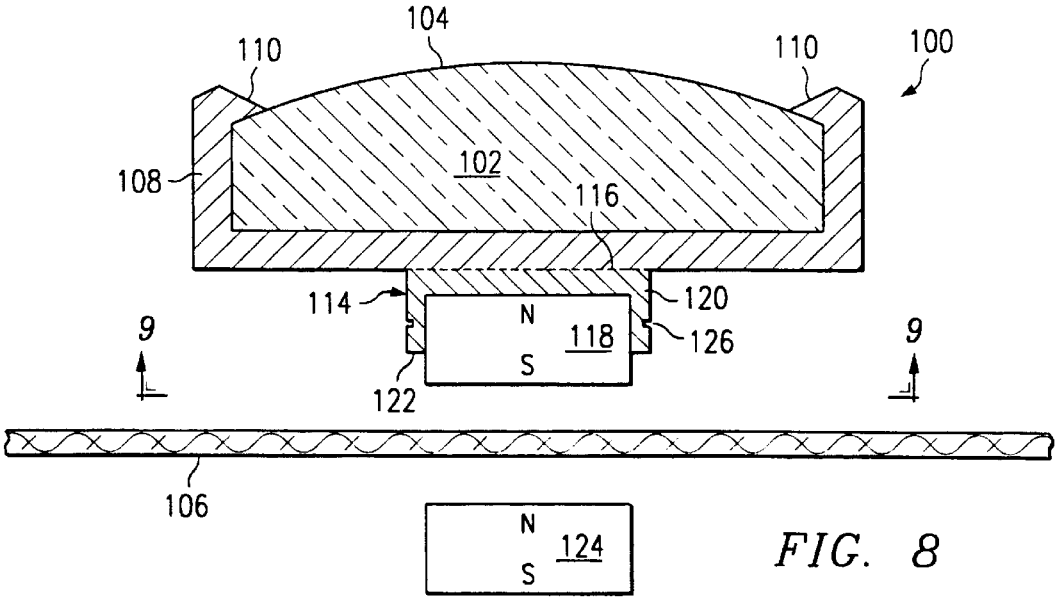
FIG. 8 is a side cross-section of another embodiment of the invention.

Now referring to FIGS. 8 and 9, another embodiment of the invention will be described. A display device to be worn by a user attachment to clothing is designated generally by reference numeral 100 in FIG. 8. The display device 100 includes a decorative or informative article 102 mounted therein, such as an item of jewelry having an exterior face 104 visible when the device 100 is worn on the exterior of a thin portion of fabric or clothing 106. Alternatively, a name tag or other informative article could be used in the device 100 in place of an item of jewelry. The display device 100 has mounting means such as a casing 108, which preferably has folded edges 110 or other such members for holding the article 102 in a fixed position in the casing.

The casing preferably has a back plate 112 against which the article 102 is seated. Secured to the exterior of the back plate is a socket 114, preferably by soldering, brazing or other suitable means along dashed line 116. Alternatively, the socket 114 can be integrally formed as a unitary part of the casing 108. A first magnet 118 with high magnetic strength properties is retained in the socket 114. The magnets poles are shown with the north pole inside the socket 114 and south pole on the exposed outer face.

Figure 9:
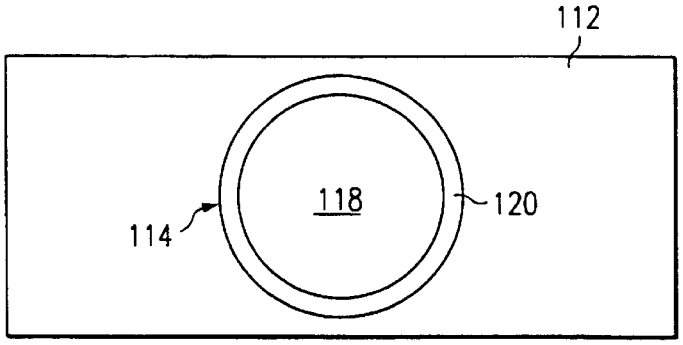
FIG. 9 is a back elevation view of part of the device of FIG. 8 looking from the perspective shown at line 9—9 of FIG. 8.

Referring to FIG. 9, the socket 114 preferably has a cylindrical wall 120 that conforms to and retains the first magnet 118, which is similarly shaped with an outside diameter slightly less than the inside diameter of the socket wall 120.

Referring again to FIG. 8, the socket wall 120 preferably extends outward from the back plate 112 to terminate at an end 122 that does not reach the outer face of the magnet 118. This arrangement facilitates bringing a second magnet 124 into close proximity to the first magnet 118 with the thin portion of fabric of the clothing item 106 therebetween. Of course, the north and south poles of the second magnet 124 are arranged to attract the two magnets together to secure the display device 100 to the item clothing 106.

The first magnet 118 can be retained in the socket 114 by a thin layer of glue between the north pole face and the adjoining surface within the socket. Alternatively, the first magnet 118 can be retained in the socket 114 by crimping the socket walls as indicated by indentations 126.

Figure 10:
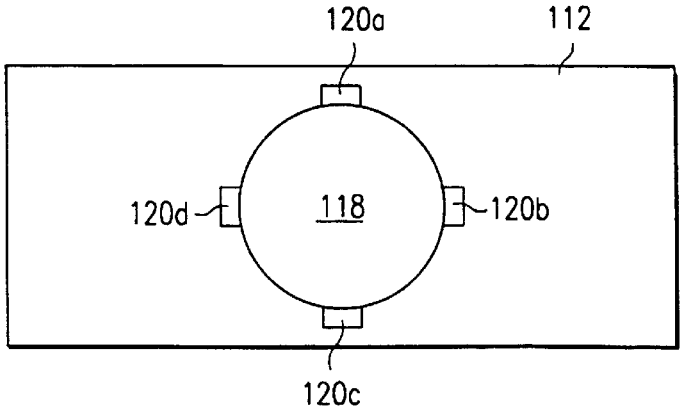
FIG. 10 is a modified form of the device of FIG. 8 looking from the same perspective as FIG. 9.

A modification for retaining the first magnet 118 in a socket or socket-like arrangement is shown in FIG. 10. Prongs 120*a*, 120*b*, 120*c* and 120*d* extend outward from the back plate and abut the circumference or side edges of the first magnet 118. The prongs 120*a*, 120*b*, 120*c* and 120*d* are preferably resilient so that the first magnet can be installed easily and retained in place by spring action. If the casing 108 is made of steel, the prongs can be formed by punching through and bending back four sections of the back plate in a manner known to skilled sheet metal fabricators.

Other modifications of the foregoing embodiments will be apparent to those skilled in the art. For example, the socket 114 of FIG. 8 can comprise a magnetically attractive metal or ferromagnetic material. This will facilitate installing and retaining the first magnet 118 in the socket since it will readily seat itself into the full depth of the socket 114. Then, the crimping step can be performed to assure permanent retention of the first magnet 118 in the socket 114. To provide an attractive appearance, the socket preferably comprises nickel-plated steel, which may also be the material of casing 108. Of course, other materials may be suitable depending on the use of the display device. For use as an item of jewelry, silver or gold-plated brass may be preferable. For use as a name tag or similar informative display device, a durable plastic or ceramic may be preferable. It will be appreciated that the casing 108 and socket 114 can be formed as unitary molded plastic item, whether used for jewelry or as part of an informative article.

Although preferred embodiments of the invention have been described in detail, it will be appreciated that various alternatives and modifications thereof are within the spirit and scope of the invention as set forth in the appended claims.

What is claimed is:

1. A display device to be worn by a user by attachment to clothing for displaying an article on the exterior of the clothing, comprising:

means for mounting the article in a fixed position, the mounting means having a back plate disposed adjacent to the article;

a socket secured to the back plate on an exterior surface thereof opposite from the article;

a first magnet retained in the socket;

the socket including means for retaining the first magnet in the socket, the retaining means extending outward away from the back plate and terminating at an end spaced from the back plate, the first magnet extending beyond the terminating end of the retaining means, the exterior surface of the back plate extending laterally beyond the dimensions of the retaining means; and a second magnet adapted to attract the first magnet through a portion of the user's clothing, whereby the second magnet can be positioned inside the user's clothing and the first magnet can be brought into close proximity to the second magnet with the portion of clothing therebetween in order to magnetically secure the display device to the user's clothing.

2. The display device of claim 1 wherein the socket is secured to the back plate by brazing.

3. The display device of claim 1 wherein the socket is integrally formed with the back plate.

4. The display device of claim 1 wherein the socket is metal and its retaining means comprises a wall that conforms to and is crimped against the edges of the first magnet.

5. A display device to be worn by a user by attachment to clothing for displaying an article on the exterior of the clothing, comprising:

means for mounting the article in a fixed position, the mounting means having a back plate disposed adjacent to the article;

a metal socket secured to the back plate on the side thereof opposite from the article;

a first magnet retained in the socket;

the socket including means for retaining the first magnet in the socket, the retaining means extending outward away from the plate and terminating at an end spaced from the back plate, the first magnet extending beyond the terminating end of the retaining means, wherein the retaining means comprises prongs that resiliently hold the first magnet in place in the socket; and a second magnet adapted to attract the first magnet through a portion of the user's clothing, whereby the second magnet can be positioned inside the user's clothing and the first magnet can be brought into close proximity to the second magnet with portion of clothing therebetween in order to magnetically secure the display device to the user's clothing.

6. The display device of claim 1 wherein the first magnet is secured in the socket by an adhesive.

7. The display device of claim 1 wherein the article comprises jewelry.

8. The display device of claim 1 wherein the article comprises a name tag.

9. The display device of claim 1 wherein the socket comprises a ferromagnetic material.

10. The display device of claim 9 wherein the socket comprises nickel-plated steel.

* * * * *